United States Patent [19]

Ohnuma et al.

[11] 4,350,749

[45] Sep. 21, 1982

[54] REVERSE DEVELOPMENT METHOD

[75] Inventors: Teruyuki Ohnuma, Yokohama; Seiichi Miyakawa, Nagareyama; Hajime Oyama, Tokyo, all of Japan

[73] Assignee: Ricoh Company Ltd., Tokyo, Japan

[21] Appl. No.: 15,471

[22] Filed: Feb. 26, 1979

[30] Foreign Application Priority Data

Feb. 28, 1978 [JP] Japan ..... 53-22484
Apr. 11, 1978 [JP] Japan ..... 53-42372

[51] Int. Cl.[3] ..... G03G 13/09

[52] U.S. Cl. ..... 430/100; 430/122; 430/903

[58] Field of Search ..... 430/122, 100; 118/657, 118/658

[56] References Cited

U.S. PATENT DOCUMENTS 3,262,806 7/1966 Gourge ..... 118/657
3,674,532 7/1972 Morse ..... 430/122
3,850,662 11/1974 Jahn ..... 430/122
4,121,931 10/1978 Nelson ..... 118/657

OTHER PUBLICATIONS

Rayford et al., "Reversal Development of Continuous--Tone Xerographic Images P&E" vol. 6, #3, 1955.

*Primary Examiner*—John E. Kittle
*Assistant Examiner*—John L. Goodrow
*Attorney, Agent, or Firm*—Wyatt, Gerber, Shoup, Scobey & Badie

[57] ABSTRACT

A reverse development is performed with application of development bias voltage to a development sleeve at the time of development, and the polarity of the bias voltage is reversed or the bias voltage is reduced to zero at the time of non-development. Furthermore, positive images and negative images can be selectively formed by changing the voltage to be applied to a charge injection electrode, without changing the bias voltage to be applied to the development sleeve.

5 Claims, 21 Drawing Figures

REVERSE DEVELOPMENT METHOD

BACKGROUND OF THE INVENTION

The present invention relates to a reverse development method capable of reversing images in electrophotographic copying machines and electrostatic recording apparatus or the like.

Conventionally, as the methods of forming a positive image from a negative image, a method of using toner charged to the same polarity as that of an electrostatic image on a recording member and a method of changing the bias voltage to be applied to a development electrode are known. These methods are described in detail in by R. M. Schaffert "Electrophotography", The Focal Press, London and N.Y. 1965, As the development methods for conducting the reverse development, a liquid development method and a magnetic brush development method employing a two-component type developer comprising toner and carriers are known. As will be described in detail later, these methods have been employed in practice without causing significant problems. However, in the case of the two-component type developer which is a mixture of toner and carriers, toner is consumed as the developer is used, so that the toner concentration becomes lowered, and a developed image with a sufficient density is not obtained when the developer is used continuously. Therefore, it is necessary to keep the quantity of toner in the developer constant by use of a toner concentration detection apparatus which acts to maintain a predetermined toner concentration. Accordingly, the development apparatus employing the two-component type developer has shortcomings in that the apparatus is complex in mechanism and high in cost.

Recently an inexpensive copying apparatus which does not necessitate much maintenance has been demanded, so that a development method employing a one-component type developer consisting of a magnetic toner has come into use. In the case of this method, reverse development cannot be performed satisfactorily by use of the same reverse development method used with the two-component type developer.

Referring to FIGS. 1 and 2, the reverse development method using conventional magnetic brush development will now be explained. In these figures, on a photoconductor 1, there exist positive charges with a potential $V_I$ in the latent image area and positive changes with a potential $V_N$ in the non-latent image area. A development roller 2 is charged to the same polarity as that of the electrostatic latent image, and a bias voltage $V_B$ which is slightly lower than the potential of the latent image area is applied to the development roller 2. As the developer is used a two-component type developer consisting of carriers 3 comprising iron filings, and positive charged toner 4. During the copying process, the bias voltage $V_B$ is constantly applied to the development roller 2. In the magnetic brush development employing such two-component type developer, spacing between the photoconductor 1 and the development roller 2 is so great that the action of the development roller 2 as a counter electrode is weak. As shown in FIG. 1, the number of lines of electric force 5 directed to the photoconductor 1 from the development roller 2 is so small that even if the bias voltage $V_B$ is applied to the development roller 2 when development is not performed, much toner is not deposited on the photoconductor 1, so that the photoconductor 1 is not smeared by the toner.

On the other hand, in the case of a development method employing a one-component type non-magnetic developer consisting only of toner, spacing between the development roller 2 and the photoconductor 1 is as small as approximately 50 μm, so that electric lines of force 6 are condensed on the photoconductor 1 as shown in FIG. 3. In the case where a magnetic toner is employed, spacing between the development roller 2 and the photoconductor 1 is slightly greater than in the case of the non-magnetic toner. However, since the resistivity of the magnetic toner is low, the electric lines of force generated by the development bias are apt to be directed to the photoconductor through the developer and accordingly, the counter electrode effect is greater than in the case where the two-component type developer is used. As a result, toner is deposited on the photoconductor by application of the bias voltage of the same polarity as that of the latent electrostatic image to the development roller during non-development as well as during development.

Referring to FIGS. 4 and 5, representative development apparatuses of the above-mentioned types will now be explained.

FIG. 4 is a schematic sectional view of a development apparatus employing a high resistivity non-magnetic toner. In FIG. 4, reference numeral 7 represents a development roller. The toner supplied from a hopper 38 is positively charged triboelectrically by a triboelectric charging blade 9. On a photoconductor 10, there is formed a negative electrostatic image with positive charge, and to the development roller 7, a bias voltage of the same polarity as that of the electrostatic image is applied, whereby reverse development is performed. At the time of development, positively charged toner is deposited in all areas except the electrostatic charge area on the photoconductor 10, so that a positive image is formed. However, if the bias voltage is continuously applied at the time of non-development, toner is deposited on the photoconductor 10 by the bias effect and consequently, the load of a cleaning apparatus (not shown) for cleaning the photoconductor 10 becomes great and the toner is wasted.

Referring to FIG. 5, there is shown a development apparatus employing a low resistivity magnetic toner. In FIG. 5, a development roller 11 comprises a non-magnetic sleeve 12 and a magnet 13 disposed inside the non-magnetic sleeve 12 to which a positive bias voltage is applied. On the sleeve 12, there is formed a magnetic brush by the magnetic toner supplied from the hopper 8. Since the magnetic toner is low in resistivity, it is not charged in advance, but has positive charge thereon due to the bias voltage applied to the sleeve 12, so that a positive image is formed with the toner deposited in an area without positive charged electrostatic image on the photoconductor 10. In this case, the magnetic toner is deposited on the photoconductor during non-development, causing the same shortcomings as in the above-mentioned example. In both cases, when the residual toner cannot be removed sufficiently with the load at the time of cleaning, a good image cannot be obtained due to the toner at the next reverse development. Particularly, in the process for obtaining one copy with two revolutions of a photoconductor, where development and cleaning are performed by the same apparatus, this problem is amplified.

SUMMARY OF THE INVENTION

It is therefore an object of the present invention to provide a method and apparatus for performing a reverse development employing one-component type developer without the above-mentioned shortcoming in the conventional reverse development method.

According to the present invention, at the time of development, with application of development bias voltage for reverse development, a fairly good reverse development is performed, while at the time of non-development, the polarity of the bias voltage is changed or set at the grounded potential, whereby deposition of the toner on a latent electrostatic image bearing member is prevented and waste of toner is also prevented and the load applied to a cleaning apparatus is significantly reduced.

Furthermore, in the present invention, since one-component type developer is employed, a toner concentration detecting apparatus is unnecessary and the development apparatus is mechanically simple and inexpensive.

In a development apparatus employing a charging electrode for charging toner, the toner charging condition is not changed at the time of non-development so that when the next development process is started, development can be performed readily.

Another object of the present invention is to provide a development method capable of copying readily when negative development is changed over to positive development and vice versa.

According to the present invention, positive images and negative images can be selectively obtained without exchanging the photoconductor and toner. Furthermore, positive images and negative images can be selectively obtained by changing the bias voltage to be applied to a charge injection electrode without changing a bias voltage to be applied to a development sleeve. Furthermore, the magnitude of the bias voltage $V_S$ to be applied to the sleeve and that of the voltage $V_E$ to be applied to the charge injection electrode are not reversed so that it never occurs that the charging polarity of the toner is changed significantly. Furthermore, in the present invention, the predominance of the charge of the charge injection electrode or that of the charge electrostatically induced by the sleeve is selectively employed.

BRIEF DESCRIPTION OF THE DRAWINGS

For a better understanding of the present invention and further objects and features thereof, reference will be had to the following detailed description to be read in conjunction of the drawings wherein.

DETAILED DESCRIPTION OF THE PREFERRED EMBODIMENTS

Figure 1:
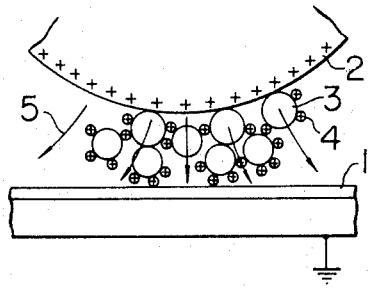
FIG. 1 PRIOR ART
FIGS. 1 and 2 are for explaining the method of the conventional reverse development.
Figure 3:
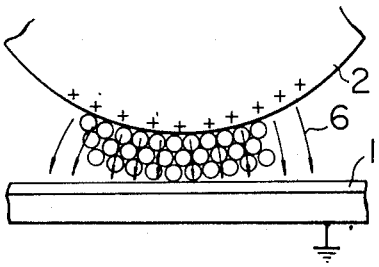
FIG. 3 is for explaining the principle of the present invention.
Figure 2:
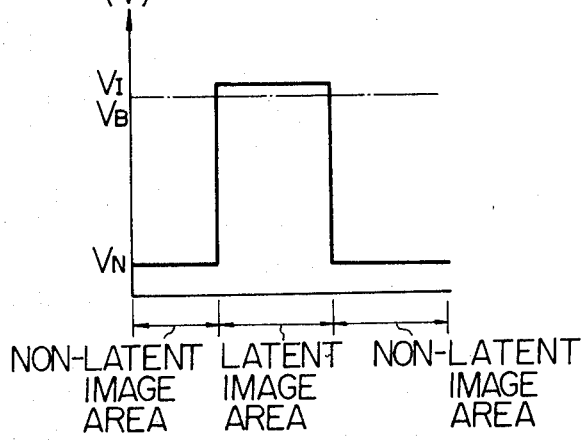
FIG. 2 PRIOR ART
Figure 4:
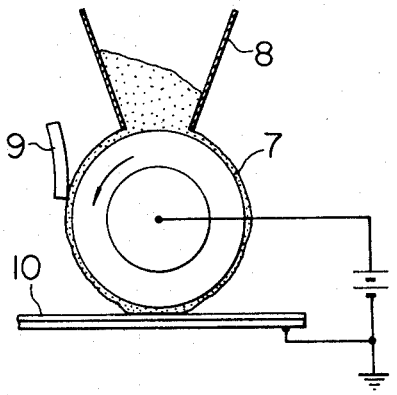
FIGS. 4 and 5 are respectively the schematic sectional views of the representative development apparatuses employing one-component type developer.
Figure 5:
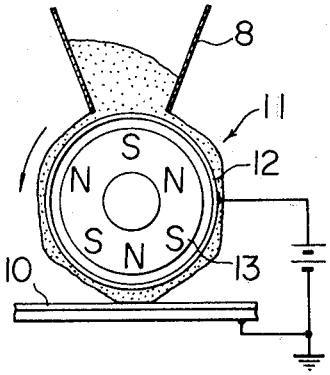
Figure 6:
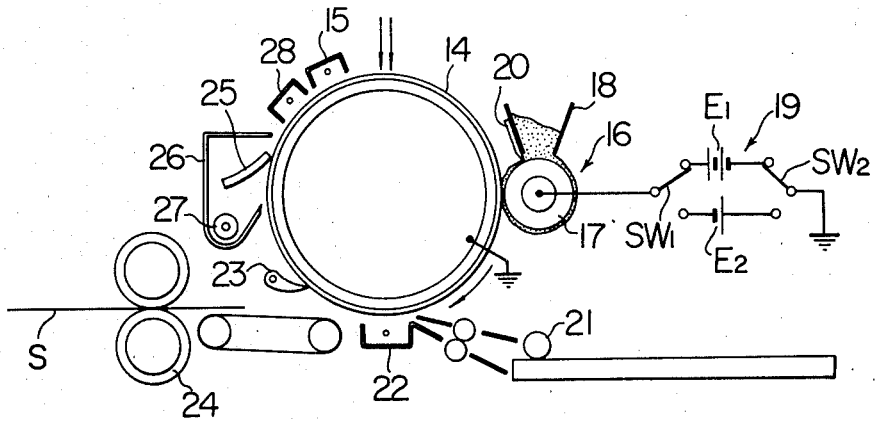
FIG. 6 is a schematic sectional view of an apparatus for performing a first embodiment of a reverse development method according to the present invention.
Figure 7:
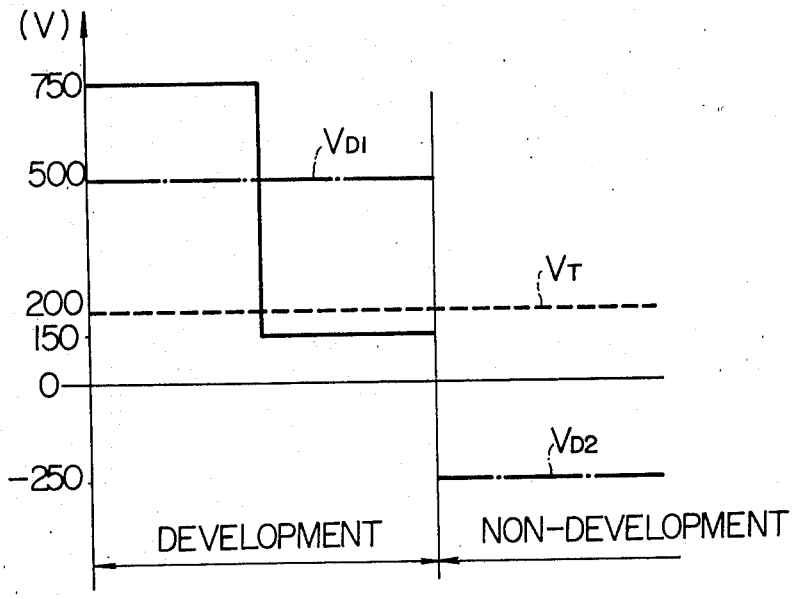
FIG. 7 is a charging diagram for explaining the principle of the first embodiment of FIG. 6.

Referring to FIG. 6, there is shown a first embodiment of a reverse development apparatus according to the present invention. In FIG. 6, reference numeral 14 represents a photoconductive drum which is rotated in the direction of the arrow. As the photoconductors for use in the present invention, zinc oxide, selenium, cadmium sulfide and organic photoconductors can be used. In the present embodiment, a selenium photoconductor is employed. The photoconductor drum 14 is positively charged uniformly by a corona charging apparatus 15 and a negative image is then projected upon the surface of the photoconductor drum 14 by a slit exposure apparatus (not shown). A negative latent electrostatic image is formed by projection of a light image from a microfilm projector or OFT. As shown in FIG. 7, a latent electrostatic image of +750 V is formed in a higher potential area, while a latent electrostatic image of +150 V is formed in a lower potential area. The thus formed latent electrostatic images are developed by a development apparatus 16. The development apparatus 16 comprises a development roller 17, a toner hopper 18, a bias voltage control apparatus 19 and a toner charging apparatus 20. The development roller 17 is a conductive silicone rubber roller whose volume resistivity is not more than $10^5$ Ωcm. Above the development roller 17, there is situated the toner hopper 18 which holds non-magnetic toner whose pressure application contact resistivity is at least $10^{13}$ Ωcm. The pressure application contact resistivity signifies the resistivity of the toner when the toner on the development roller 17 is brought into pressure contact with the photoconductor drum 14 during development as will be described in detail.

There are two types of development methods. One method is to develop with pressure application while the other method is to develop with normal pressure, and they must be strictly distinguished. In this specification, the resistivity of toner is represented by specific volume resistivity. The toner comprises a resin such as an epoxy base resin, a styrene resin and a phenol resin; a coloring agent, such as carbon black, red iron oxide, ultramarine, and potassium carbonate; and additives, such as a silicone elastomer, silica, ethylene cellulose, and polytetrafluoroethylene. As a toner for use in this embodiment, the toner in the ordinary two-component type developer can be used.

The toner supplied from the toner hopper 18 is charged to +200 V by the toner charging apparatus 20 comprising a triboelectric charging blade. In FIG. 7, the dotted line indicates the charged potential $V_T$ of the toner. A predetermined bias voltage is applied to the bias voltage control apparatus 19. The bias voltage control apparatus 19 has a power source $E_1$ of +500 V and a power source $E_2$ of −250 V, and the development roller 17 is connected to either the power source $E_1$ or the power source $E_2$ by change-over switches $SW_1$ and $SW_2$. At the time of development, the voltage of the power source $E_1$ is applied to the development roller 17 as shown in FIG. 6. In FIG. 7, this voltage is represented by $V_{D1}$. During development, the apparent potential of a high potential portion of the image with respect to the roller 17 is positive, while that of a low potential portion is apparently −350 V, so that positively charged toner is deposited on the low potential portion and reverse development is performed. During non-development, the change-over switches $SW_1$ and $SW_2$ are switched over and −250 V of voltage $V_{D2}$ is applied to the development roller 17 from the power source $E_2$. In the case where the surface potential of the photoconductor drum 14 is zero, the apparent potential of the photoconductor surface with respect to the development roller 17 is +250 V. Even if the residual surface potential of the photoconductor drum 14 is thirty volts or so, toner is not deposited on the photoconductor drum 14 since the toner is charged positively. The non-development time means a period of time before and after the image area formed on the photoconductor drum 14 passes through the development section. In a copying machine in which a sequence control is performed with respect to the development process by a program or the like, central control equipment controls the switches $SW_1$ and $SW_2$ so as to be changed over when the image area reaches the development section or when the image area has passed over the development section. In the case where the photoconductor drum 14 is provided with a sequence cam, the size of the original or the length of image formed on the photoconductor drum 14 is detected in advance and the time when the leading edge of the image area reaches the development section is detected by a sequence cam and the time when the image area has passed over the development section is detected in accordance with the length of the image area, whereby the switches $SW_1$ and $SW_2$ are changed over.

The thus developed toner image is electrostatically transferred, by a corona image transfer apparatus 22, to a transfer paper S fed by a paper feed apparatus 21. The transfer paper S to which the toner image has been transferred is separated from the photoconductor drum 14 by a separation apparatus 23 and the toner image is permanently fixed to the transfer paper S. In the meantime, after image transfer, untransferred residual toner is removed from the photoconductor drum 14 by a cleaning blade 25. The removed toner is recovered into a lower portion of a cleaning apparatus 26 and is then transported in the axial direction of the photoconductor drum 14 by a spiral member 27 and returned to the development apparatus for re-use of the recovered toner. The development apparatus 16 is connected to the cleaning apparatus 26 by a toner transportation member (not shown) so as to return the toner to the hopper 18. After cleaning, the residual potential of the photoconductor drum 14 is removed by a charge quenching apparatus 28 so that one copying process is completed.

Figure 8:
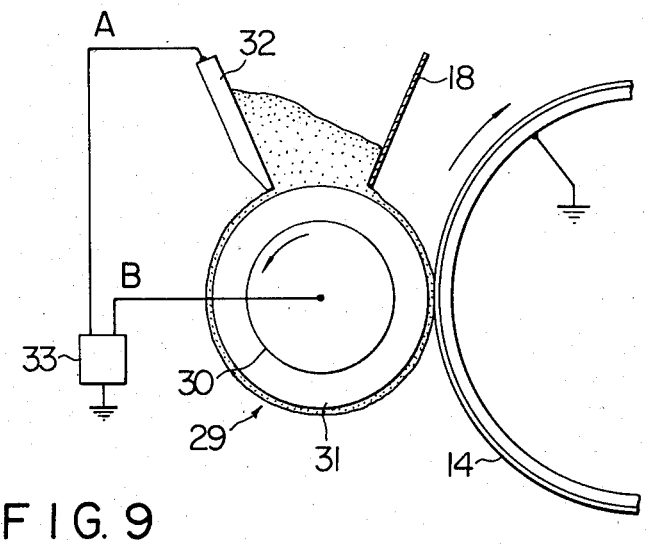
FIG. 8 is a schematic sectional view of an apparatus for performing a second embodiment of a reverse development method according to the present invention.
Figure 9:
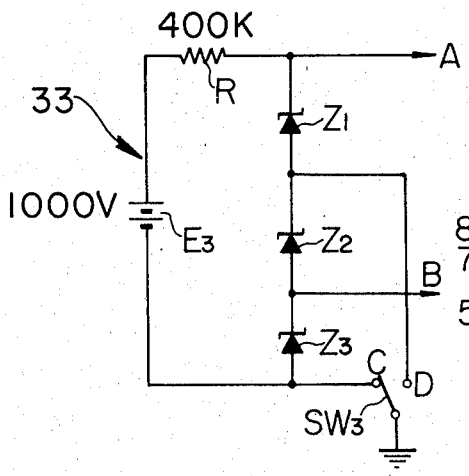
FIG. 9 is the diagram of the power source control circuits for use in the second embodiment of FIG. 8.
Figure 10:
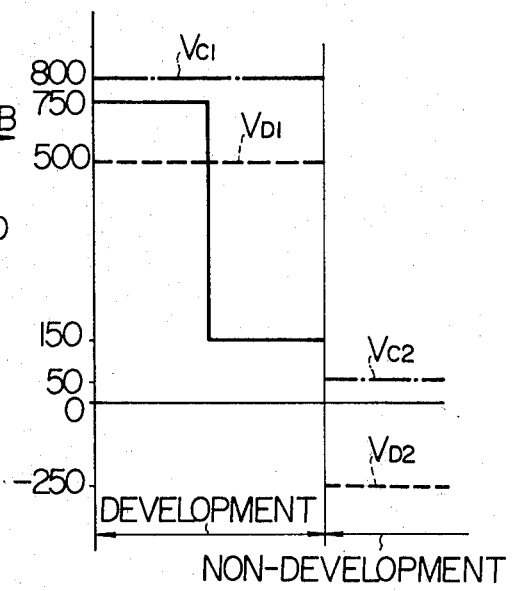
FIG. 10 is a charging diagram for explaining the principle of the second embodiment of FIG. 8.

Referring to FIG. 8 through FIG. 10, there is shown a second embodiment of the present invention. In the second embodiment, a charge injection method is employed for charging the toner, instead of the triboelectric charging method in the first embodiment. The other portions of the second embodiment are almost the same as those of the first embodiment. In FIG. 8, the members having the same functions as those of the first embodiment are given identical reference numerals. The development roller 29 comprises a conductive elastic layer 31 formed on a conductive shaft 30. The conductive elastic layer 31 is made of the same material as that of the development roller 17 in the first embodiment. Furthermore, as the materials for use in the conductive elastic layer 31, conductively treated chloroprene rubber and polyurethane rubber and the like are useful since they attract toner thereto. The development roller 29 is rotated in the direction of the arrow at the same peripheral speed as that of the photoconductive drum 14 and is in appropriate pressure contact with the surface of the photoconductor drum 14 in the same manner as that in the first embodiment. Above the development roller 29, there is situated a toner hopper 18 in which the same toner is held as in the case of the first embodiment. The back side wall of the toner hopper 18 serves as a charging electrode 32 as well. The charging electrode 32 is a flat plate extending in the axial direction of the development roller 29 and has a sharp lower edge. In practice, the lower edge is made to have a minute curvature, for instance, with the radius of curvature 0.5 R. The charging electrode 32 is disposed so as to have a small clearance from the development roller 29 and serves as a doctor for controlling the toner supplied to the development roller 29 at a predetermined thickness. When the toner passes under the charging electrode 32, the toner is charged to the same polarity (positive) as that of a latent electrostatic image formed on the surface of the photoconductor drum 14. To be more specific, to the charging electrode 32, there is applied +800 V as the first charging voltage $V_{cl}$, while to the conductive shaft 30 of the development roller 29, there is applied +500 V as the first development voltage $V_{D1}$. The charge quantity of the toner on the development roller 29 depends upon the potential difference between the charging electrode 32 and the surface of the development roller 29. Furthermore, when the charging electrode 32 is at a higher potential, the toner is positively charged, when the development roller 29 is at a higher potential, the toner is negatively charged. The potential difference during development is 300 volts. On the photoconductor drum 14, there are formed a latent electrostatic image of +750 V in the latent image area and a latent electrostatic image +150 V in the non-latent image area and since the development bias voltage $V_{D1}$ is +500 volts, the apparent voltage of the latent electrostatic image area with respect to roller 29 is +250 volts, while in the non-latent image area, the apparent voltage is −350 volts. Therefore, the positively charged toner is deposited only in the non-latent image area, without being deposited in the latent image area, so that reverse development is performed. At the time of non-development, the first development bias voltage $V_{D1}$ is changed over to the second development bias voltage $V_{D2}$, which is −250 volts. Since the toner is positively charged, toner is deposited on the photoconductor drum 14 with the first development bias voltage $V_{D1}$ at the time of development. Therefore, the bias voltage has to be changed over to the opposite polarity. However, when only the development bias voltage is changed, the potential difference between the charging electrode 32 and the development roller 29 becomes 1050 volts, so that toner is abnormally charged to a high potential. As a result, toner is charged under a condition deviated from the optimum charging condition of the toner, so that development cannot be performed readily. Furthermore, in this case, hysteresis of the abnormal charging is caused so that normal development becomes impossible. Therefore, some countermeasure has to be taken so that proper charging of toner can be performed. In order to do this, the potential of the charging electrode 32 is changed over to the second charging potential $V_{c2}$, +50 volts, so as to maintain the potential difference between the charging electrode 32 and the development roller 29 at 300 volts. It is preferable that the change-over of the development bias voltage and that of the charging potential be performed cooperatively. FIG. 10 shows the interrelationship between the potential of the photoconductor drum 14, the charging voltage and the development bias voltage. In the above-mentioned embodiment, the power source control circuit 33 is employed as shown in FIG. 9. In FIG. 9, +1000 volt is used as power source $E_3$. Three Zener diodes $Z_1$, $Z_2$ and $Z_3$ are connected in parallel with the power source $E_3$. Between the power source $E_3$ and wire A, there is disposed a resistor R of 400K, and the wire A is connected to the charging electrode 32. Between the Zener diodes $Z_2$ and $Z_3$, wire B is connected, which is further connected to the development roller 29. The negative side of the power source $E_3$ is connected to contact C of the switch $SW_3$, and between Zener diodes $Z_1$ and $Z_2$, there is connected contact D of switch $SW_3$. The Zener diodes $Z_1$, $Z_2$ and $Z_3$ respectively have 50 volts, 250 volts and 500 volts of breakover voltage characteristics.

The function of the circuits of the present embodiment is as follows: At the time of development, the switch $SW_3$ is on the side of the contact C and at this time, +800 V potential (+50 V+250 V+500 V) is applied to the charging electrode 32, and +500 V potential is applied to the development roller 29. On the other hand, at the time of non-development, the switch $SW_3$ is changed over to the side of the contact D by the control apparatus as in the case of the first embodiment. At this time, +50 V potential is applied to the charging electrode 32 and −250 V potential to the development roller 29. Thus, during development and non-development, the voltage is changed with the potential difference between the charging electrode 32 and the development roller 29 maintained.

As just described a single voltage power source is employed. However, different power sources can be used for use with the charging electroder 32 and the development roller 29, respectively. Furthermore, four power sources can be employed instead of applying four different voltages.

Figure 11:
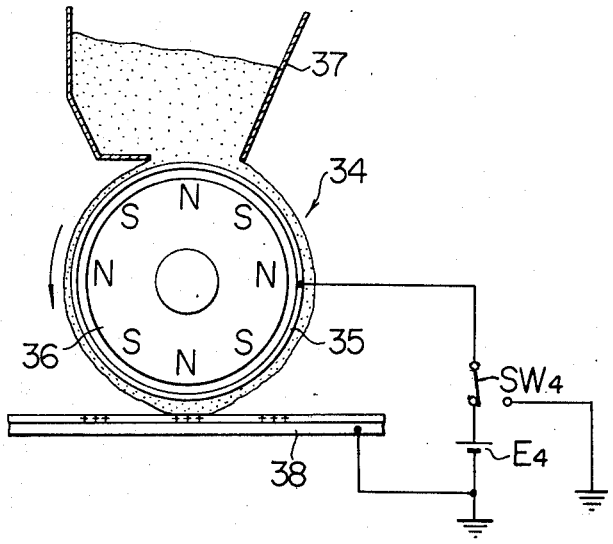
FIG. 11 is a schematic sectional view of an apparatus for performing a third embodiment of a reverse development method according to the present invention.
Figure 12:
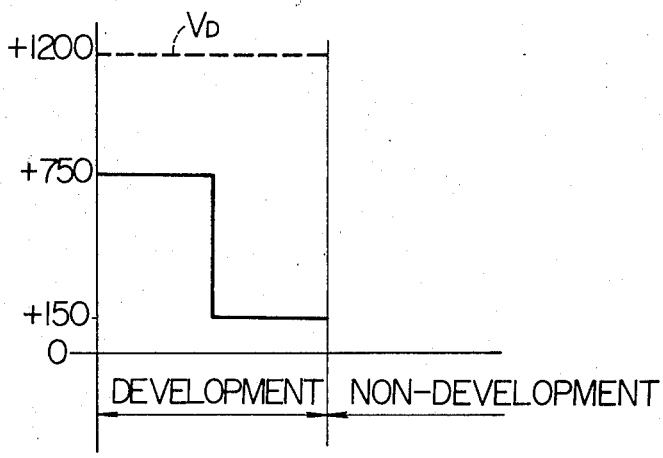
FIG. 12 is a charging diagram for explaining the principle of the third embodiment of FIG. 11.

Referring to FIGS. 11 and 12, there is shown a third embodiment of the present invention. In FIG. 11, reference numeral 34 represents a development roller, which comprises a sleeve 35 which is rotated in the direction of the arrow and is electrically conductive and non-magnetic and a magnetic roller 36 which is fixed inside the sleeve 34 and magnetized alternately to N pole and S pole. The sleeve 35 can be made of aluminium, for example. Above the development roller 34, there is situated a toner hopper 37 in which magnetic toner is held. In the present embodiment, magnetic toner of $10^{12}$ Ωcm of pressure application contact resistivity is employed. On the sleeve 35, there is formed a magnetic brush consisting of the magnetic toner by the magnetic force of the magnetic roller 36, and the clearance between the development roller 34 and a photoconductor 38 is set so that the magnetic brush is brought into pressure contact with the photoconductor 38. On the photoconductor 38, there is formed a positively charged latent electrostatic image, and as shown in FIG. 12, the potential of a high potential portion is +750 volts, and that of a low potential portion is +150 volts. At the time of development, a switch $SW_4$ is closed and +1200 V development bias voltage $V_D$ is applied to the sleeve 35 by a power source $E_4$. When this bias voltage is applied to the sleeve 35, the toner becomes high in potential in the same polarity as that of the sleeve 35 since the magnetic toner is comparatively conductive and overcomes negative charges generated by electrostatic induction and behaves as if it were charged positively. Therefore, as positively charged toner will be drawn to a more negative region, the toner is deposited only on a non-image area, so that reverse development is effected. After the development, the switch $SW_4$ is opened, so that no voltage is applied to the sleeve 35. At the time of non-development, the sleeve 35 is grounded and the potential of the toner is made the ground potential, whereby the toner is continuously attracted magnetically to the sleeve 35 and no toner is deposited on the photoconductor 38 even if the toner is brought into contact with the photoconductor 38. In this case, when a positive or negative bias voltage is applied to the sleeve 35, the toner is deposited on the photoconductor 38. Therefore, care has to be taken. What is necessary to the magnetic brush development apparatus is that the magnetic toner is moved by the relative movement of the sleeve and the magnet. Therefore, in the magnetic brush development apparatus, the magnetic roller can be designed so as to be rotated with the sleeve fixed, or both the magnetic roller and the sleeve can be rotated. Furthermore, the magnetic brush development apparatus is not limited to the roller type apparatus, but a belt-shaped apparatus can be employed as well. Furthermore, a plurality of development rollers can be employed instead of a single development roller. And the development method according to the present invention can be applied to the so-called two-revolution one copy process in which the development roller also serves as a cleaning apparatus.

In the first and second embodiments of the present invention, the non-magnetic toner is employed, but the toner is not limited to non-magnetic toner and a high resistivity magnetic toner can be charged likewise by use of a charging member. In such a case, as the development roller, the development roller as shown in the third embodiment according to the present invention is suitable.

Furthermore, in the above-mentioned embodiments, the photoconductor is employed as a latent electrostatic image bearing member. In addition to this, dielectrics can be likewise employed as the latent electrostatic image bearing member.

Figure 13:
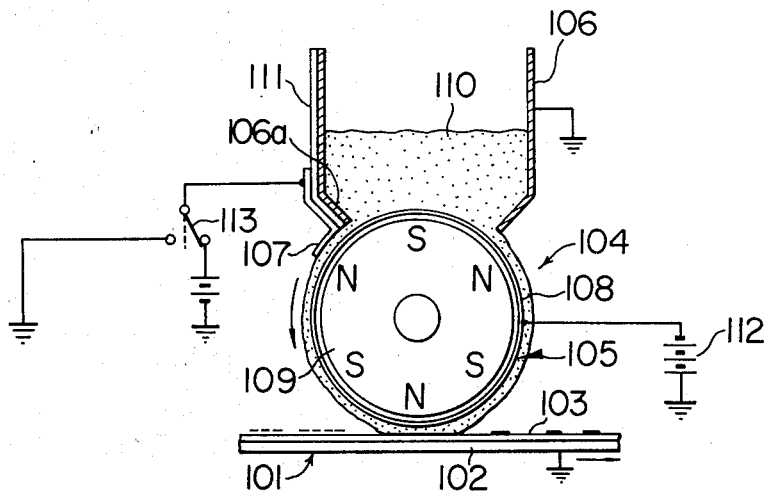
FIG. 13 is a schematic sectional view of a magnetic brush development apparatus for performing a fourth embodiment of the method according to the present invention.

Referring to FIG. 13, there is shown schematically a sectional view of a fourth embodiment of a development apparatus according to the present invention. In FIG. 13, reference numeral 101 represents a photoconductor in which a photoconductive layer 103 is formed on a grounded conductive support member 102. As the photoconductor 101, an organic photoconductor (polyvinylcarbazole) is employed. The other known photoconductors can be also used in the present invention. On the surface of the photoconductor 101, there is formed a latent electrostatic image. For example, the potential $V_I$ of the latent electrostatic image is −800 volts, while the potential $V_N$ of the non-image area is −200 volts. A development apparatus 104 comprises a development roller 105, a toner supply hopper 106 and a charge injection electrode 107. The development roller 105 comprises a non-magnetic and electrically conductive cylindrical sleeve 108, which is made of aluminum, for example, and a magnetic roller 109 which is magnetized with alternate N poles and S poles and is disposed inside the cylindrical sleeve 108. The magnetic roller 109 is fixed, while the sleeve 108 is rotated counterclockwise. So long as the sleeve 108 and the magnetic roller 109 are moved relatively, the development roller 105 is not limited to the above-mentioned construction. The clearance $P_G$ between the sleeve 108 and the photoconductor 101 (FIGS. 15 and 16) have to be always kept constant. Above the development roller 105, there is disposed the toner supply hopper 106 in which one-component type magnetic developer 110 (hereafter simply referred to as the magnetic toner) is held. The hopper 106 is made of a grounded conductive member capable of preventing unnecessary charging of the magnetic toner held in the hopper 106, so that uniformly charged magnetic toner is supplied from the hopper 106. The magnetic toner 110 in the hopper 106 is deposited on the sleeve 108 by the magnetic attraction of the magnetic roller 109 and is transported in the direction of the rotation of the sleeve 108. The outlet end **106*a* of the hopper 106 serves as a doctor for regulating the quantity of the magnetic toner discharged from the hopper 106 by the sleeve 108. To the outer wall of the hopper 106 near the outlet end 106*a*, there is attached a charge injection electrode 107. The charge injection electrode 107 is made of a conductive material and constitutes part of a concentric circle with respect to the sleeve 108. The clearance $D_G$ between the sleeve 108 and the surface of the charge injection electrode 107 facing the sleeve 108 is constant, and the relationship that $D_G$ is greater than $P_G$ is necessary for development. The charge injection electrode 7 can be shaped like a flat plate or can be formed so that its lower portion is made sharp. Furthermore, it is possible to design the charge injection electrode 107** so as to serve as a doctor for regulating the developer.

On the sleeve 108, there is formed a magnetic brush consisting of the magnetic toner with a uniform thickness, which mechanically brushes the surface of the photoconductor 101 and develops a latent electrostatic image formed on the photoconductor 101.

About −1000 volt potential is applied to the sleeve 108 as the development bias voltage $V_S$ by a bias power source 112. The development bias voltage $V_S$ and the latent electrostatic image potential $V_I$ have to satisfy the relationship of $|V_S - V_I| < V_K$, where $V_K$ is the development initiation voltage, which is about 300 volts in the present embodiment.

Figure 14:
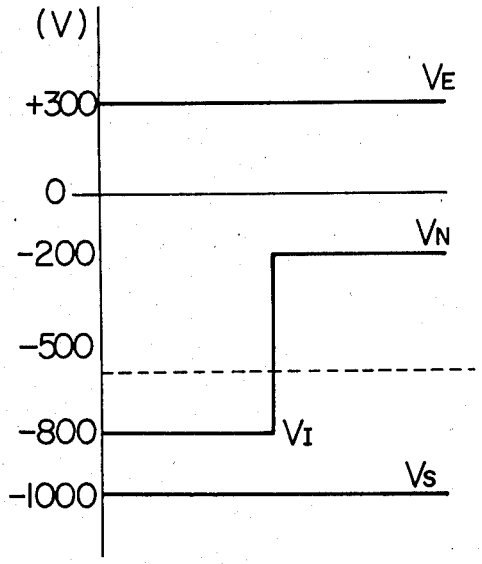
FIG. 14 is a charging diagram showing the magnitude of the potential in the fourth embodiment when a positive image is obtained.
Figure 15:
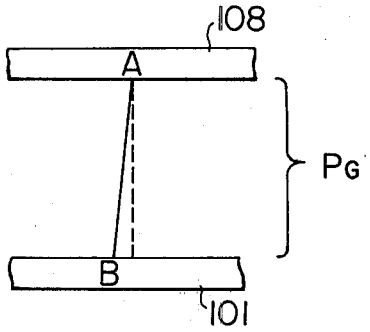
FIGS. 15 and 16 show how the development bias voltage applied to a development sleeve is effective.
Figure 16:
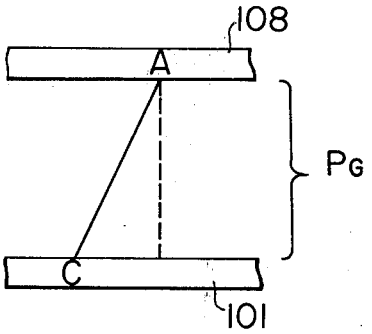
Figure 17:
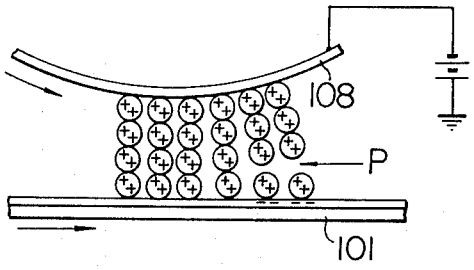
FIG. 17 shows the principle of development performed by charging of a charge injection electrode.

To the charge injection electrode 107, there is applied +300 volt potential by a switch 113. The voltage $V_E$ to be applied to the charge injection electrode 107 is opposite in polarity to that of the latent electrostatic image or the charge injection electrode 107 is grounded. The magnetic toner which passes under the charge injection electrode 107 is positively charged by the potential difference between the charge injection electrode 107 and the sleeve 108. FIG. 14 shows the relationship between the above-mentioned potentials. In the case of the one-component type magnetic toner, the bias development exhibits a phenomenon which is considerably different from that in the case of the ordinary two-component type developer. FIG. 15 shows the change of the bias voltage applied to the sleeve when a two-component type developer comprising toner and carriers consisting of iron filings is used. For instance, the voltage at point A of the sleeve 108 is −1000 volts, the effect of the voltage on the surface of the photoconductor 101 is rather great and the voltage at point B is about −800 volts, with a small change of the voltage. Naturally, when the resistivity of the developer changes, the above-mentioned value may change. However, in the case of the two-component type developer, the above-mentioned result is obtained since the carrier is rather electrically conductive. On the other hand, as shown in FIG. 16, the magnetic toner suitable for charge injection is high in volume resistivity. In the case of the present embodiment, the magnetic toner whose resistivity is in the range of $10^{13}$ to $10^{14}$ Ωcm is employed. Therefore, in the case of the magnetic toner, even when −1000 volt potential is applied to the sleeve 108, the potential at point C on the surface of the photoconductor 101 is lowered to about −500 volts. Referring to FIG. 17, there is shown a development model at the time of development. One reason for such a reduction of the potential may be that the magnetic toner is positively charged by the charge injection electrode 107 and the magnetic toner layer is rather thick so that the negative bias voltage $V_S$ applied to the sleeve 108 is reduced. Therefore, at a division point P where the magnetic toner deposited on the photoconductor 101 and the toner attracted magnetically to the sleeve 108 are separated, it is estimated that the development bias voltage $V_S$ is about −600 volts. Due to such phenomenon, even when the development bias voltage $V_S$, which has already been explained by referring to FIGS. 13 and 14, is applied, the apparent potential of the electrostatic latent image portion is negative with respect to the potential at P, while the apparent potential of the non-image portion is positive, when the effective bias potential is taken into consideration, so that positively charged toner is deposited in the latent electrostatic portion and the so-called positive image is formed.

Figure 18:
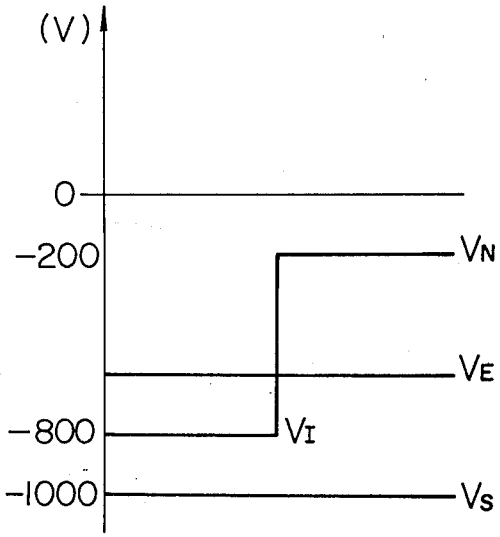
FIG. 18 is a charging diagram showing the magnitude of the potential in the fourth embodiment when a negative image is obtained.
Figure 19:
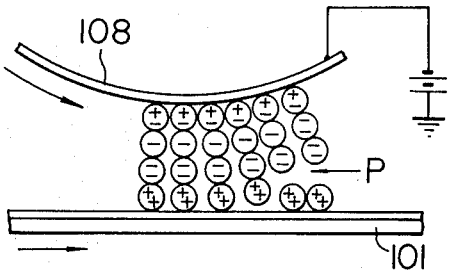
FIG. 19 shows the principle of development by use of electrostatic induction.

In the case where a negative image is to be formed, referring to FIG. 13, the switch 113 is changed over to the position indicated by the dotted line. When the switch 113 is in this position, the charge injection electrode 107 is electrically isolated and is brought in a float condition. Since the charge injection electrode 107 is disposed in close proximity to the sleeve 108, the charge injection electrode 107 is greatly effected by the potential of the sleeve 108 and is charged to the same polarity as that of the bias voltage $V_S$ applied to the sleeve 108, so that the relationship becomes that which is shown in FIG. 18. In this case, the potential difference ($V_S - V_E$) between the charge injection electrode 107 and the sleeve 108 becomes considerably smaller than that in the case of the positive image formation, so that the toner is less charged. The charge magnitude is several nanocoulomb/gram. As a result, the effect of the effective bias voltage becomes greater than that in the case of positive image, and in the non-image area with a great potential difference, development is effected by electrostatic induction, so that the latent electrostatic image area with a small potential difference is hardly developed. A development model in this case is shown in FIG. 19.

Namely, only the toner surface layer portion is positively charged and in this toner, negative charges are generated by electrostatic induction by the bias voltage from the sleeve 108 and the effective bias voltage at point P becomes high. Therefore, in the non-image area, the apparent potential is positive and considerably high, while in the latent electrostatic image area, the apparent potential is low, so that a negative image is formed on the photoconductor.

In a fifth embodiment according to the present invention, a development apparatus with the same construction as that of the development apparatus in the fourth embodiment of the present invention is employed. They differ in the manner of applying bias voltage to be applied to the sleeve and the charge injection electrode.

Figure 20:
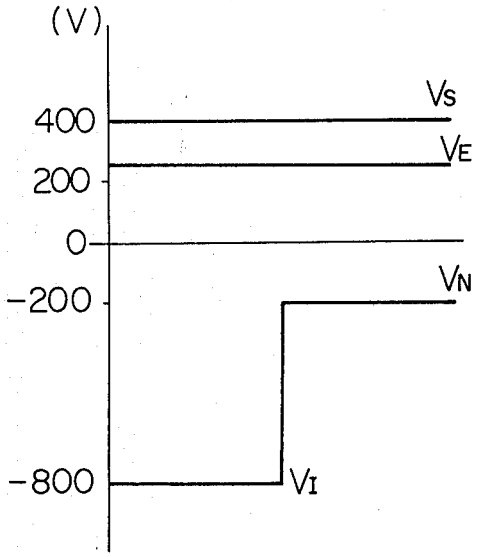
FIGS. 20 and 21 respectively show the magnitude of the potentials in a fifth embodiment according to the present invention when positive images and negative images are obtained.

In the case where a positive image is to be obtained, the following procedure is taken: On the photoconductor 101, a latent electrostatic image with −800 V potential $V_I$ is formed as in the case of the fourth embodiment, and the potential $V_N$ in the non-image area is −200 volts. As shown in FIG. 20, to the sleeve 108, there is applied a potential whose polarity is opposite to that of the latent electrostatic image and whose absolute value is as small as 400 volts. Namely, the development bias voltage $V_S$ and the potential of the latent electrostatic image are set so as to satisfy the relationship of $|V_S| < |V_I|$. In the meantime, to the charge injection electrode 107, there is applied a voltage $V_E$ whose polarity is opposite to that of the latent electrostatic image. The voltage $V_E$ can be applied by use of an external power source or by use of a principle that a voltage of the same polarity as that of the bias voltage $V_S$ is induced by the bias voltage $V_S$ applied to the sleeve 108 with the charge injection electrode 107 electrically isolated. The potential difference between the voltage $V_E$ of the charge injection electrode 107 and the voltage $V_S$ of the sleeve 108 is so small that the magnetic toner is not sufficiently charged by the charge injection electrode 107 and at the time of development, the toner is charged positively, its polarity remaining the same as that of the bias voltage $V_S$, by the electrostatic induction phenomenon caused by the bias voltage $V_S$ applied to the sleeve 108. Therefore, the electrostatic latent image having negative charge is developed at a high image density and thus a positive image can be obtained.

Figure 21:
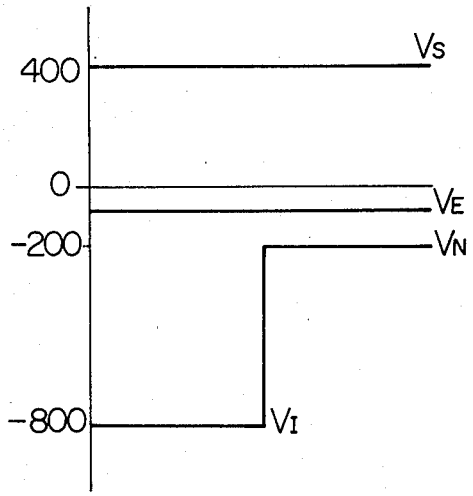

A negative image can be obtained by changing only the voltage $V_E$ of the charge injection electrode 107. As shown in FIG. 21, the bias voltage $V_S$ applied to the sleeve 108 is constant and the voltage $V_E$ of the charge injection electrode 107 is set in the same polarity as that of the latent electrostatic image or at the grounded potential. Therefore, the potential difference between the application voltage $V_E$ of the charge injection electrode 107 and the bias voltage $V_S$ applied to the sleeve 108 becomes great and the magnetic toner is negatively charged. Since the magnetic toner is negatively charged, it is not deposited on the negatively charged latent electrostatic image area, but deposited on the non-image area which is negatively charged, but lower in potential. Thus, a negative image is obtained. In this case, the toner is charged sufficiently, development is completed before injection of the charge opposite in polarity to that of the toner, which is caused by electrostatic induction, is effected.

What is claimed is:

1. A reverse development method for use in electrophotography employing one-component type developer consisting of a toner having a volume resistivity not less than $10^{13}$ Ωcm in powder form to develop a latent electrostatic image formed on a recording member, comprising the steps of:

supplying said toner by a developer supply means having an elastic outer surface serving to press the toner against the latent electrostatic image, charging said toner to the same polarity as that of the latent electrostatic image, applying bias voltage to said developer supply means, setting the polarity of said bias voltage at the same polarity as that of said latent electrostatic image during the time of development of said latent electrostatic image, and setting the polarity of said bias voltage at the opposite polarity to that of said latent electrostatic image after the latent electrostatic image has been developed.

2. A reverse development method for use in electrophotography employing one-component type developer consisting of a toner having a volume resistivity not less than $10^{13}$ Ωcm in powder form to develop a latent electrostatic image on a recording member, comprising the steps of:

supplying said toner by a developer supply means having an elastic outer surface serving to press the toner against the latent electrostatic image, bringing a charging electrode into contact with said toner and charging said toner to the same polarity as that of the latent electrostatic image, applying a bias voltage to said charging electrode, applying a development bias voltage to said developer supply means at a different potential from said bias voltage applied to said charging electrode, setting said development bias voltage at the same polarity as that of said latent electrostatic image during the time of development of said latent electrostatic image, and setting said development bias voltage at the opposite polarity to that of said latent electrostatic image after the latent electrostatic image has been developed and at the same time, changing said bias voltage applied to said charging electrode so as to maintain the same potential difference between said development bias voltage and said charging electrode.

3. In a development method for use in electrophotography for developing a latent electrostatic image formed on a photoconductor with a magnetic toner attracted magnetically to a development sleeve and charged by use of a charge injection electrode, the improvement comprising the steps of:

setting a bias voltage $V_S$ applied to said development sleeve at the same polarity as that of said latent electrostatic image, with said bias voltage $V_S$ and the surface potential $V_I$ of an image portion of said photoconductor set so as to satisfy the relationship of $|V_S| > |V_I|$; and at the same time setting a voltage $V_E$ applied to said charge injection electrode at the opposite polarity to that of said latent electrostatic image or at grounded potential when a positive image is to be obtained, and setting said voltage $V_E$ applied to said charge injection electrode at the same polarity as that of said latent electrostatic image when a negative image is to be obtained.

4. In a development method for use in electrophotography for developing a latent electrostatic image formed on a photoconductor with a magnetic toner attracted magnetically to a development sleeve and charged by use of a charge injection electrode, the improvement comprising the steps of:

setting a bias voltage $V_S$ applied to said development sleeve at the opposite polarity to that of said latent electrostatic image, with said bias voltage $V_S$ and the surface potential $V_I$ of an image area of said photoconductor set so as to satisfy the relationship of $|V_S| > |V_I|$; and at the same time, setting a voltage $V_E$ applied to said charge injection electrode at the opposite polarity to that of said electrostatic latent image when a positive image is to be obtained, and setting said voltage $V_E$ applied to said charge injection electrode at the same polarity as that of said latent electrostatic image or at ground potential when a negative image is to be obtained.

5. A reverse development method for use in electrophotography employing one-component type developer consisting of a toner having a volume resistivity not less than $10^{13}$ Ωcm in powder form to develop a latent electrostatic image on a recording member, comprising the steps of:

supplying said toner by a developer supply means including means for forming said developer in a magnetic brush adapted to be brought into contact with the latent electrostatic image, bringing a charging electrode into contact with said toner and charging said toner to the same polarity as that of the latent electrostatic image, applying a bias voltage to said charging electrode, applying a development bias voltage to said developer supply means at a different potential from said bias voltage applied to said charging electrode, setting said development bias voltage at the same polarity as that of said latent electrostatic image during the time of developement and setting said development bias voltage at the opposite polarity to that of said latent electrostatic image after the latent electrostatic image has been developed and at the same time, changing said bias voltage applied to said charging electrode so as to maintain the same potential difference between said development bias voltage and said charging electrode.

* * * * *